US011794217B2

(12) United States Patent
Bock et al.

(10) Patent No.: US 11,794,217 B2
(45) Date of Patent: Oct. 24, 2023

(54) CLEANING APPARATUSES AND DEVICES FOR APPLYING CLEANING FLUID TO SUBSTRATES

(71) Applicant: GOJO Industries, Inc., Akron, OH (US)

(72) Inventors: Stephanie Bock, Rittman, OH (US); Mark T. Smith, Canton, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 1022 days.

(21) Appl. No.: 16/587,694

(22) Filed: Sep. 30, 2019

(65) Prior Publication Data

US 2020/0101499 A1 Apr. 2, 2020

Related U.S. Application Data

(60) Provisional application No. 62/739,398, filed on Oct. 1, 2018.

(51) Int. Cl.

| | |
|---|---|
| ***B08B 3/04*** | (2006.01) |
| ***F04B 45/04*** | (2006.01) |
| ***F04B 13/02*** | (2006.01) |
| ***F04B 43/02*** | (2006.01) |
| ***A47L 11/40*** | (2006.01) |
| *B08B 1/00* | (2006.01) |
| *A47L 13/58* | (2006.01) |

(52) U.S. Cl.

CPC ..... *B08B 3/047* (2013.01); *A47L 11/4016* (2013.01); *A47L 11/4083* (2013.01); *A47L 11/4088* (2013.01); *F04B 13/02* (2013.01); *F04B 43/02* (2013.01); *F04B 45/04* (2013.01); *A47L 13/58* (2013.01); *B08B 1/007* (2013.01)

(58) Field of Classification Search

CPC ..... B08B 3/047; B08B 1/007; A47L 11/4016; A47L 11/4083; A47L 11/4088; A47L 13/58; F04B 13/02; F04B 43/02; F04B 45/04

USPC ..... 134/94.1

See application file for complete search history.

(56) References Cited

U.S. PATENT DOCUMENTS 9,226,640 B1 * 1/2016 Wulff ..... A47L 13/58
9,936,848 B2 * 4/2018 Brain ..... A47L 13/59
(Continued)

*Primary Examiner* — David G Cormier
*Assistant Examiner* — Thomas Bucci
(74) *Attorney, Agent, or Firm* — Calfee, Halter & Griswold LLP

(57) ABSTRACT

Exemplary embodiments of cleaning buckets are shown and described herein. An exemplary cleaning bucket includes a housing that has a cleaning solution reservoir, a dirty water reservoir and an insert for inserting into the housing. The housing has a first surface. The first surface covers the cleaning solution reservoir. The first surface is configured to allow water to flow into the dirty water reservoir through one or more openings allowing fluid to flow into the dirty water reservoir. The insert further includes a cleaning solution dispensing member located on the first surface, a pump for drawing cleaning solution out of the cleaning solution reservoir; and an activation device for causing the pump to pump fluid from the cleaning solution reservoir to the cleaning solution dispensing member.

19 Claims, 12 Drawing Sheets

(56) References Cited

U.S. PATENT DOCUMENTS

| | | | | |
|---|---|---|---|---|
| 2007/0226942 | A1* | 10/2007 | Damrath | A47L 13/58 15/260 |
| 2010/0095473 | A1* | 4/2010 | Azancot | A47J 47/18 15/264 |
| 2010/0200615 | A1* | 8/2010 | Ciavarella | B05B 11/1087 222/207 |
| 2012/0298148 | A1* | 11/2012 | McLain | B24D 13/00 134/116 |
| 2015/0089753 | A1* | 4/2015 | Field | A46B 13/008 15/93.1 |
| 2018/0028040 | A1* | 2/2018 | Delangue | B08B 3/02 |
| 2018/0279849 | A1* | 10/2018 | Dingert | A47L 13/58 |

* cited by examiner

CLEANING APPARATUSES AND DEVICES FOR APPLYING CLEANING FLUID TO SUBSTRATES

RELATED APPLICATIONS

This application claims the benefits of, and priority to, U.S. Provisional Patent Application Ser. No. 62/739,398, which was filed on Oct. 1, 2018 and which is incorporated herein by reference in its entirety.

BACKGROUND

Generally when cleaning with a cleaning apparatus, such as, for example, a scrub bucket, the bucket is filled with clean water and a cleaning agent. A cleaning person wets a sponge or mop in the bucket, scrubs a dirty surface, rings the sponge or mop out in the bucket and repeats. Accordingly, the dirt and grime removed from the surface ends up in the bucket causing the cleaning solution to be contaminated. As a result, after a brief period of cleaning the water is dirty and the surface may not be cleaned as well as one would like.

If the cleaning person is not using a cleaning apparatus, such as a bucket, the person may spray down the surface with the cleaning solution and then uses a rag or sponge to clean the surface. Dirt and grim collects on the rag or sponge and may be spread to other areas. A third option that may be used are pre-moistened substrates, such as, for example, wipes that are used once and thrown away. While this later application is more hygienic, it is also more expensive and suffers from problems, such as, for example, dry out, once the container of pre-moistened substrates has been opened.

SUMMARY

Exemplary embodiments of cleaning apparatuses are disclosed herein. An exemplary embodiment of a cleaning apparatus includes a housing, a wetting/wiping surface, a membrane located over at least a portion of the wetting/wiping surface and one or more cleaning fluid outlet ports located proximate the wetting/wiping surface. The cleaning apparatus further includes a cleaning fluid reservoir or container, a pump in fluid communication with the cleaning fluid reservoir and the one or more cleaning fluid outlet pumps and an activation device for controlling the pump. Wherein the activation device is located below the wetting/wiping surface.

An exemplary cleaning apparatus for wetting a substrate includes a housing, a substrate wetting/wiping surface secured to the housing, a membrane located over at least a portion of the wetting/wiping surface, one or more cleaning fluid outlet ports located proximate the wetting/wiping surface, a cleaning fluid reservoir, a pump in fluid communication with the cleaning fluid reservoir and the one or more cleaning fluid outlet pumps, and an activation device for controlling the pump. Activation device is located below the wetting/wiping surface and the membrane is configured so that the activation device may be activated through a portion of the membrane.

Another exemplary cleaning device includes a housing having a wetting/wiping surface that is covered by a membrane, a cleaning fluid container located within the housing and one or more cleaning fluid outlet ports proximate the wetting wiping surface. A pump for pumping fluid from the cleaning fluid container to the one or more cleaning fluid outlet ports, wherein fluid from the one or more cleaning fluid outlet ports flows onto the wetting/wiping surface is also included. The cleaning apparatus further includes an activation device located proximate the wetting/wiping surface, wherein the activation device causes the pump to pump fluid from the cleaning fluid container to the wetting/wiping surface.

Another cleaning apparatus includes a housing that includes a cleaning fluid reservoir and a dirty water reservoir. The cleaning apparatus includes an insert for inserting into the housing. The insert has a first surface covering at least a portion the dirty water reservoir. The first surface is configured to allow water to flow into the dirty water reservoir. The cleaning apparatus further includes a wetting/wiping surface and one or more cleaning fluid outlet ports located proximate the wetting/wiping surface. A pump for drawing cleaning fluid out of the cleaning fluid reservoir and pumping the cleaning fluid out of the one or more cleaning fluid outlet ports and a activation device for causing the pump to pump fluid from the cleaning fluid reservoir to the one or more cleaning fluid outlet ports are also included.

Exemplary embodiments of cleaning buckets are shown and described herein. An exemplary cleaning bucket includes a housing that has a cleaning solution reservoir, a dirty water reservoir and an insert for inserting into the housing. The housing has a first surface. The first surface covers the cleaning solution reservoir. The first surface is configured to allow water to flow into the dirty water reservoir through one or more openings allowing fluid to flow into the dirty water reservoir. The insert further includes a cleaning solution dispensing member located on the first surface, a pump for drawing cleaning solution out of the cleaning solution reservoir; and an activation device for causing the pump to pump fluid from the cleaning solution reservoir to the cleaning solution dispensing member.

Another exemplary cleaning bucket includes a housing, a first housing and a second housing. A cleaning solution reservoir is formed at least in part by the first housing and a dirty water reservoir formed at least in part by the second housing. An insert for inserting for covering the cleaning solution reservoir and a portion of the dirty water reservoir is also included. The insert includes a first surface covering the cleaning solution reservoir, wherein the first surface is configured to allow water to flow into the dirty water reservoir. The first surface includes one or more openings through the first surface allowing fluid to flow into the dirty water reservoir. A cleaning solution dispensing member is located on the first surface. A pump for drawing cleaning solution out of the cleaning solution reservoir is also included. An activation device for causing the pump to pump fluid from the cleaning solution reservoir to the cleaning solution dispensing member is further included.

An exemplary insert for a cleaning bucket includes a housing forming a clean water reservoir. The housing includes a first surface covering the cleaning solution reservoir. The first surface is configured to prevent water to flow into the cleaning solution reservoir. The first surface has one or more openings allowing fluid to flow into a dirty water reservoir. In addition, the first surface has a cleaning solution dispensing member located on the first surface. A pump for drawing cleaning solution out of the cleaning solution reservoir and an activation device for causing the pump to pump fluid from the cleaning solution reservoir to the cleaning solution.

BRIEF DESCRIPTION OF THE DRAWINGS

These and other features and advantages of the present invention will become better understood with regard to the following description and accompanying drawings in which.

DETAILED DESCRIPTION

The Detailed Description merely describes exemplary embodiments of the invention and is not intended to limit the scope of the claims in any way. Indeed, the invention is broader than and unlimited by the exemplary embodiments, and the terms used in the claims have their full ordinary meaning. In addition, any exemplar mythologies may include additional blocks or steps or may have some blocks or steps removed. Further, the blocks or steps may be performed in different orders. In the event the claims read at least one of A and B, it should be understood that the claims should be construed to require at least one of A or at least one of B, and not at least one of A and at least one of B.

Some of the exemplary embodiments shown and described in detail herein have a cylindrical shape. It should be understood that the shape of the cleaning apparatuses are not limited to being cylindrical. Indeed, the cleaning apparatuses, which may be generically called "buckets" herein may be have a square shape, a rectangular shape, a polygonal shape, an oval shape or the like. In addition, although the exemplary embodiments show and describe the clean water containment area located in the center of the dirty water containment area, other configurations may be utilized. For example, the clean water containment area may be located on one side of the bucket and the dirty water area on the other side of the container. In some embodiments, the dirty water area is located in the center of the clean water containment area. In some embodiments, the clean water area is located below the dirty water containment area. In some embodiments, the dirty water containment area is located below the clean water containment area. In some embodiments, the clean water containment area is connected to an insert that is removable from the outer containment area and the clean water containment area is removed with the insert.

Figure 1:
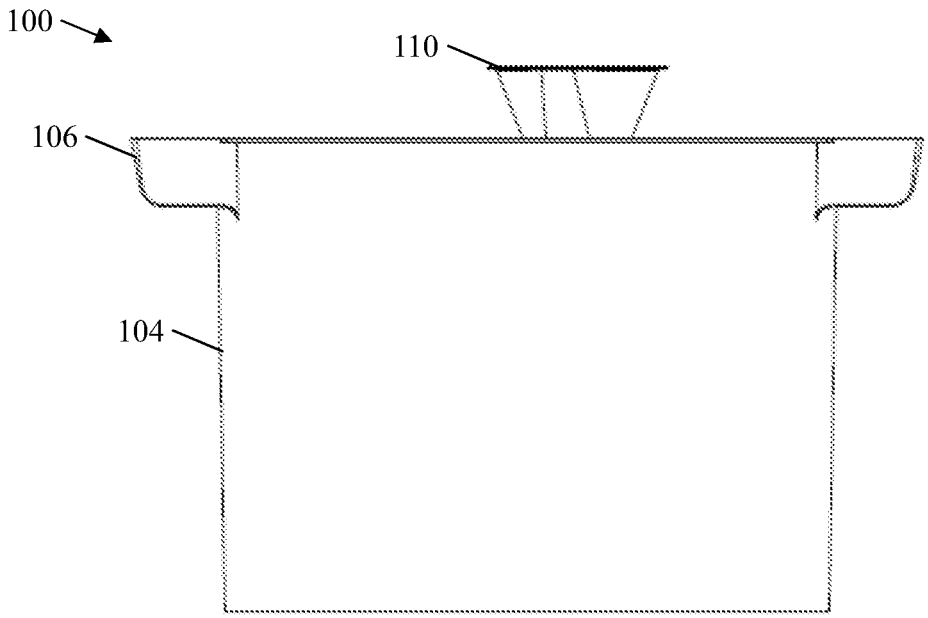
FIG. 1 is side view of an exemplary embodiment of a cleaning apparatus having a clean water compartment and a dirty water compartment.

FIG. 1 is side view of an exemplary embodiment of a cleaning device, such as, for example, a cleaning apparatus 100 having a clean water/cleaning solution compartment and a dirty water compartment. The term bucket may be used herein to describe the cleaning apparatus and the term "bucket" should be construed broadly and include any sort of container configured to perform the functions described herein. The exemplary cleaning apparatus 100 includes a first containment wall 104 that has a cylindrical shaped body and it includes a bottom (not shown). Exemplary cleaning apparatus 100 includes a pair of optional handles 106. In some embodiments, no handles are required. In some embodiments, a single handle (not shown), for example, a wire with a plastic grip, is connected to opposing sides of the surface 104 and may be rotated up to the center of the cleaning apparatus 100 when the cleaning apparatus 100 is being carried and rotated out of the way when the bucket 100 is not being carried. In some embodiments, a base (not shown) having wheels receives the cleaning apparatus 100 and the cleaning apparatus 100 may be rolled from place to place. The exemplary cleaning apparatus 100 includes an optional clean water fill funnel 110. Funnel 110 may be removable from the cleaning apparatus 100 and kept in the area that the cleaning apparatus 100 is filled and/or emptied. In some embodiment, when the funnel 110 is removed from cleaning apparatus 100, a sealing member (not shown) may be used to seal the opening into the cleaning solution containment area (not shown).

Figure 2:
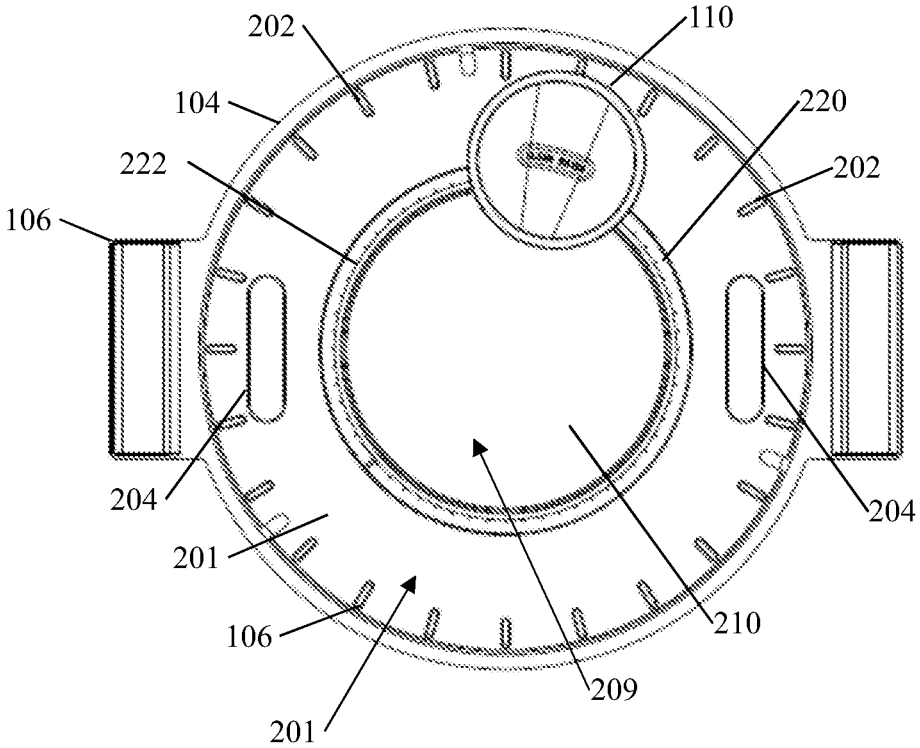
FIG. 2 is a top view of the exemplary embodiment of a cleaning apparatus of FIG. 1.

FIG. 2 is a top view of the exemplary embodiment of a cleaning apparatus 100. Cleaning apparatus 100 includes an insert 200. Insert 200 is removable from the cleaning apparatus 100 and includes a pair of optional handles 204. Optional handles 204 may be any type of handles, and in some embodiments are openings sized to allow a person's fingers to pass through to grip insert 200 and lift the insert 200 out. Preferably, insert 200 is held in place by first containment area wall 104 and gravity. In some embodiments, insert 200 is secured to first containment area wall 104 with one or more securing members (not shown) so that it cannot be removed prior to releasing the one or more securing members. The optional securing member may be one or more latches, catches, snaps, a threaded connection, or the like.

In this exemplary embodiment, located around the perimeter of insert 200 is a plurality of dirty water drain holes 202 or slots. In some embodiments, the dirty water drain holes 202 are preferably sized to prevent splashing of dirty water from the dirty water containment area (not shown) below the dirty water drain holes and preferably sized to allow dirt and grime in the dirty water to flow through without clogging up the dirty water drain holes 202. The dirty water drain holes 202 are in surface 201. Preferably surface 201 is sloped downward toward the dirty water drain holes 202. In some embodiments, surface 201 slopes downward away from the center of the cleaning bucket 100. Depending on the configuration of the dirty water containment area (not shown), the location of the dirty water drain holes 202 may be arranged accordingly. For example, if the dirty water containment area (not shown) is on one side of the bucket, the dirty water drain holes may be along only one side of surface 201. In addition, surface 201 may contain additional dirty water drain holes along any portion of its surface. The drain holes 202 may have many different shapes and sizes, such as, for example, oval, circular, triangular, rectangular, and the like.

Insert 200 includes a cleaning fluid dispensing surface 220 that that has one or more cleaning fluid outlet ports 222. In some embodiments dispensing surface 220 has a circular shape, or is in the form of a ring (as shown). In some embodiments, dispensing surface 220 is a longitudinal surface. In some embodiments, dispensing surface 220 is a plurality of longitudinal surfaces. In some embodiments, dispensing surface 220 is located along one side of the cleaning apparatus 100. In some embodiments, the cleaning fluid outlet ports 222 are arranged in a single row, a plurality of rows, an arcuate row, a plurality of arcuate rows, or the like. In some exemplary embodiments, the one or more cleaning solution outlets 222 are sized so that they limit the flow of cleaning fluid to a desired flow that allows a user to wet a substrate, such as, for example, a sponge, a cloth, a wipe or mop or other substrate without having excessive amounts of the unused cleaning solution flowing into the dirty water drain holes 202.

Located in the center of the dispensing surface 220 is a wiping area 209. Wiping area 209 may be used to, for example, wipe a substantiate on while wetting the substrate to apply an even distribution of fluid to the substrate. In some embodiments, wiping area is covered by an optional membrane 210. Membrane 210 may be used to protect components under the membrane 210. In some embodiments, membrane 210 is a flexible membrane and may be made of 0.001-0.250 thick plastic film materials, such as, for example, LDPE, Nylon, PVC, Acetate, HDPE, Vinyl, or elastomeric materials such as natural rubber, EPDM, Nitrile, Urethane, Silicone, Butyl Rubber etc.

A flexible membrane is one means contemplated for allowing for the manipulation of a switch 310 (FIG. 3) to activate/deactivate a pump 312 for pumping cleaning solution from the reservoir out through the one or more cleaning solution outlet ports 222. In some embodiments, a flexible membrane allows for operation of a manual pump (not shown) under the membrane for manually pumping cleaning fluid out of the one or more cleaning fluid outlet ports 222. In one exemplary embodiment the flexible membrane easily flexes over the required pump stroke length. In some embodiments, a membrane is not used and instead is a solid movable piece, or a combination of pieces that resist or prevent water from flowing past but allows for up and down movement may be used. With a solid movable piece, a gasket (not shown) may be use to form a seal around the movable piece. In some embodiments, the movable piece or part is made of a material, such as, for example, polyvinylchloride (PVC). In some embodiments the movable piece or part may be moved up and down to cause a pump to pump cleaning fluid or solution out of one or more cleaning solution outlet ports 222. In some embodiments, a membrane 210 is not used and a switch, such as, for example, waterproof pushbutton switch or toggle switch is used to turn on and off the flow of cleaning solution. In some embodiments, the switch is located in the sentential area. In some embodiments, a remote switch may be used and remotely activated. For example, a button may be worn on the user's body, and pushing the button may cause the pump to activate. In some embodiments, a timer is used to control the length of time or volume of cleaning solution that is dispensed. When the timer runs out, the pump turns off. In some embodiments, a sensor, such as for example, a proximity sensor that can distinguish between a user's hand and a cloth, sponge or mop or other substrate to turn on and/or off the flow of cleaning solution when a person's hand is placed in front of the sensor and does not turn on or off the flow of water if a cloth, sponge, mop or other substrate is placed in the vicinity of the switch. In some embodiments a sensor may be used to detect a hand, a substrate, such as, for example, a wipe, a cloth, a sponge or a mop in the vicinity of the cleaning bucket 100 and that proximity initiates a flow of the cleaning solution.

Figure 3:
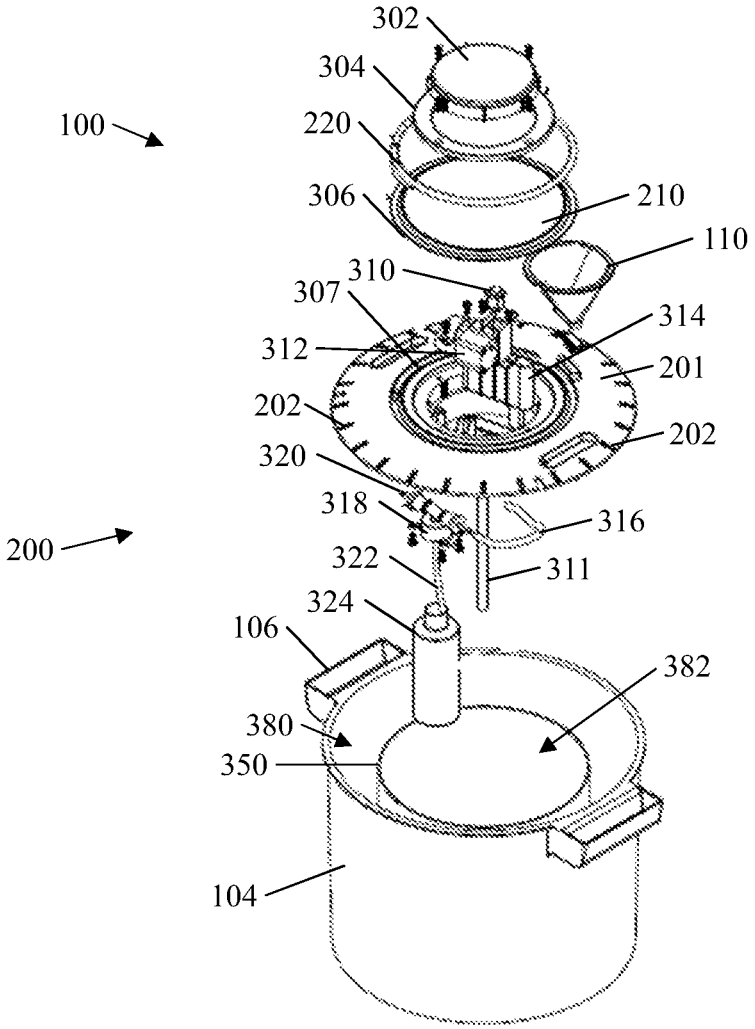
FIG. 3 is an exploded view of the exemplary embodiment of a cleaning apparatus of FIG. 1.

FIG. 3 is an exploded view of the exemplary embodiment of a cleaning apparatus 100. Exemplary cleaning apparatus 100 includes an outer containment wall 104, an inter containment wall 350 and an insert 200. One or more bottoms (not shown) are connected to the outer containment wall 104 and the inner containment wall 350 to form the respective containment areas. A dirty water containment reservoir 380 is formed between outer containment wall 104 and inter containment wall 350 and the one or more bottoms. A cleaning fluid reservoir 382 is formed by the inter containment wall 350 and the one or more bottoms. The terms "dirty water" and "cleaning water" as used herein are not limited to water or water based solutions and may be used interchangeably with cleaning fluids that do not include water or are not water based. In addition, the term "cleaning" may also be used interchangeably with the term "sanitizing".

Insert 200 includes a pump 312, an on/off switch 310, a power supply 314 and other necessary electronic circuitry needed to perform one or more functions described herein. A dip tube 311 extends from the inlet of pump 312 to the bottom of the cleaning water reservoir 382 when insert 200 is inserted into bucket 100. A first conduit 316 extends from the outlet of pump 312 to an inlet of a venturi device 318. A second conduit 320 connects the outlet of the venturi device 318 to the dispensing surface 220. A concentrate container 324, holding a concentrated cleaning solution, is connected to venturi device 318 and a dip tube 322 extends from an inlet of venturi device 318 to the bottom of concentrate container 324, when concentrate container 324 is connected to venturi device 318. During operation, when pump 312 is energized, fluid from cleaning solution reservoir 382 flows up through dip tube 311, through pump 312, through first conduit 316 and through venture 318. A vacuum pressure is created in dip tube 322 as fluid flows through venturi 318 which draws concentrated cleaning fluid from concentrate container 322 and into the fluid flowing out of venturi 318 through second conduit 320 and out of cleaning solution dispensing surface 220 through one or more cleaning solution outlet ports 222. Pump 312 may be any type of pump, such as, for example, a piston pump, a diaphragm pump, or the like. Exemplary sequentially activated diaphragm pumps are shown and described in U.S. Pat. Nos. 9,943,196, 10,065,199, 10,080,466, 10,080,467, 10,143,339, and 10,080,468, which are incorporated herein in their entirety by reference. The exemplary sequentially activated diaphragm pumps are configured to pump air from one or more diaphragms and fluid from the remaining pump diaphragms. In some embodiments, the present invention uses one or more of the pumps disclosed in the incorporated patents. In some embodiments, all of the pump diaphragms are configured to pump fluid out of the cleaning water reservoir (i.e. none of them pump air). In some embodiments, a venturi type system is not used and one or more of the pump diaphragms are configured to pump the concentrate fluid and the remaining pump diagrams are configured to pump fluid out of the cleaning water reservoir. Other modifications may be made to the incorporated pumps to work with various embodiments disclosed within this specification.

Insert 200 includes a surface 201. Secured to surface 201 is a guide ring 304 which retains a pushbutton 302. In some embodiments, a biasing member, such as, for example, a spring biases pushbutton 302 outward. Pushbutton 302 is able to slide inward and outward within guide ring 304 to engage switch 310. Pushing switch 310 downward a first time causes power to be transmitted to pump 312. Pushing switch 310 downward a second time causes power to be cut-off from pump 312. In some embodiments, a timer causes power to be cut-off from pump 312 and pushing the pushbutton a second time is not required. Membrane 210 is located over the top of pushbutton 302 and is secured to surface 201 by bead 306 which is engaged by annular groove 307 to create a weather resistant seal with surface 201. Cleaning solution dispensing surface 220 is also secured to surface 201. In some embodiments, one or more gaskets and/or seals (not shown) are used to create a weather resistant seal between pushbutton 392 and surface 201 and the optional membrane 210 may not be required.

During operation, a user cause the pump 312 to be turned on by pressing button 302. Fluid is drawn up through dip tube 311 and passes through pump 312. The fluid flows past venturi 318 and out of the one or more cleaning fluid outlets 222. The user wets a substrate (not shown) by wiping it over the surface 221 and/or cleaning fluid outlets 222. When the substrate is sufficiently moistened, the user may push pushbutton 302 again to stop the flow of fluid. The user uses the moistened substrate to clean an area and may wring the substrate out over the surface 201 allowing the dirty water to flow into the dirty water containment area.

Figure 4:
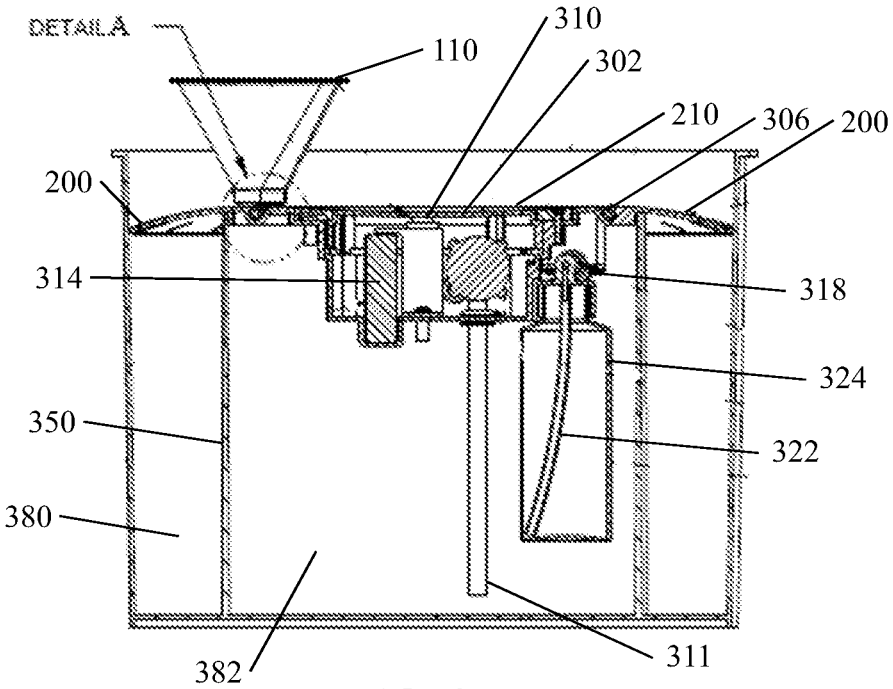
FIG. 4 is a cross-section of the exemplary embodiment of the apparatus of FIG. 1.
Figure 5:
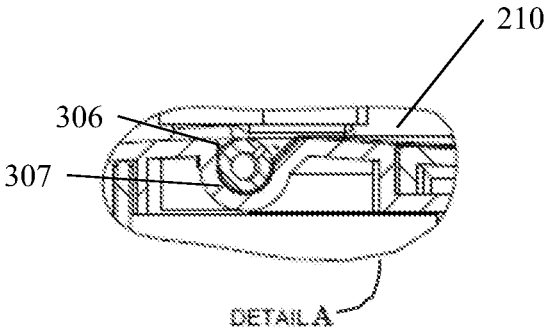
FIG. 5 is an enlarged partial section of a portion of the exemplary apparatus of FIG. 1.

FIG. 4 is a cross-section of the exemplary embodiment of the bucket 100. The components have all been described above and are not being re-described herein. FIG. 5 is an enlarged partial section of a portion of the exemplary cleaning apparatus 100 more clearly illustrating retaining bead 306 secured to annular groove 307.

Figure 6:
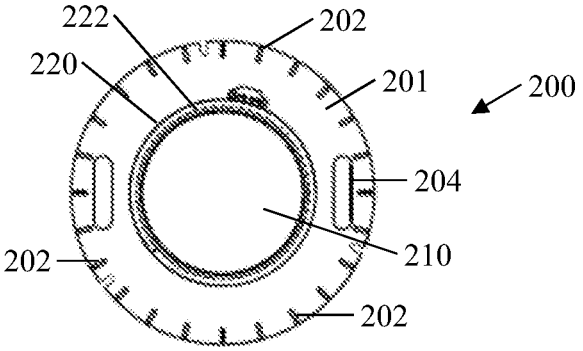
FIG. 6 is a top view of a portion of the exemplary embodiment of FIG. 1.
Figure 7:
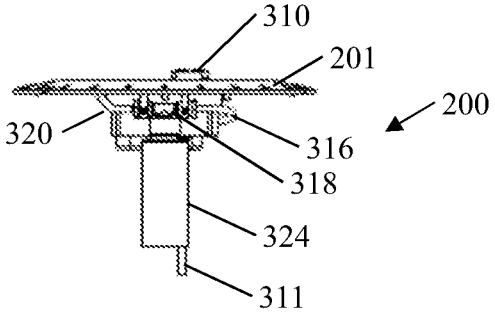
FIG. 7 is a side view of the portion of the exemplary embodiment of FIG. 6.
Figure 7A:
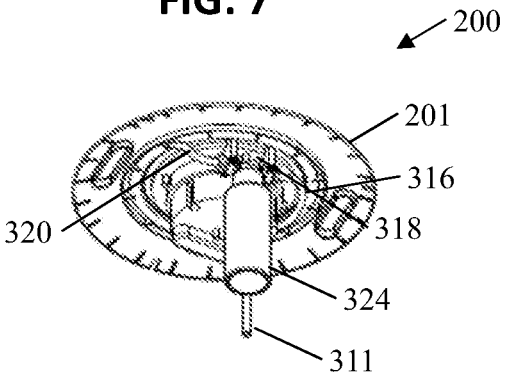
FIG. 7A is a prospective view of the portion of the exemplary embodiment of FIG. 6.

FIG. 6 is a top view of the exemplary insert 200, FIG. 7 is a side view of the portion of the exemplary insert 200 and FIG. 7A is a prospective view of the exemplary insert 200.

Figure 8:
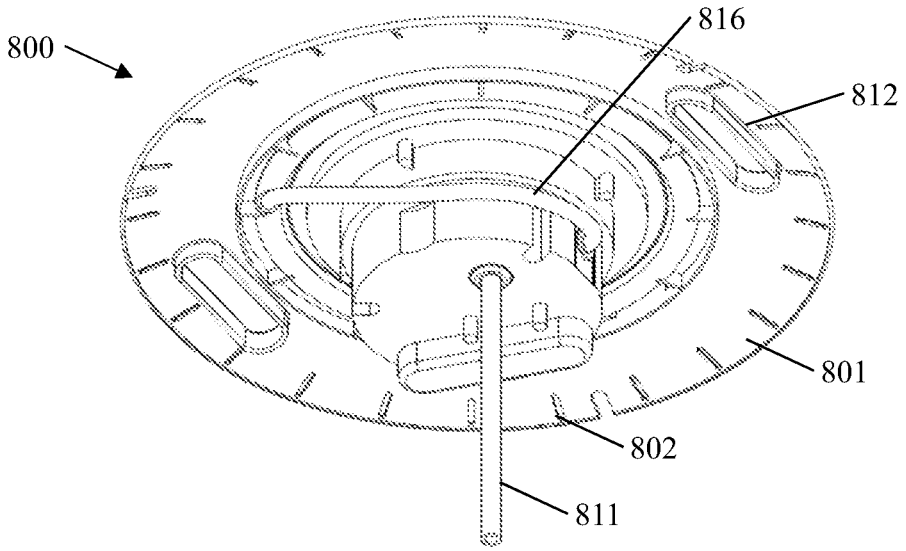
FIG. 8 is prospective view of an exemplary portion of another exemplary cleaning apparatus.

FIG. 8 is prospective view of an exemplary insert portion 800 of another exemplary cleaning apparatus (not shown). This exemplary embodiment does not include a concentrate container or venturi device. Accordingly, if it is desired to use an additive in the cleaning solution, the additive is added directly to the fluid in the clean-water reservoir. The exemplary insert includes a dip tube 811, a pump (not shown), which may be, for example, one of the pumps incorporated herein, a cleaning solution outlet conduit 816 (which connects to one or more cleaning fluid outlets (not shown), a dirty water drain surface 801 that includes one or more drain holes 802 that allow dirty water to drain into a dirty water reservoir (not shown). The exemplary insert 800 may be used with any of the clean water and dirty water reservoirs discussed above.

Figure 9:
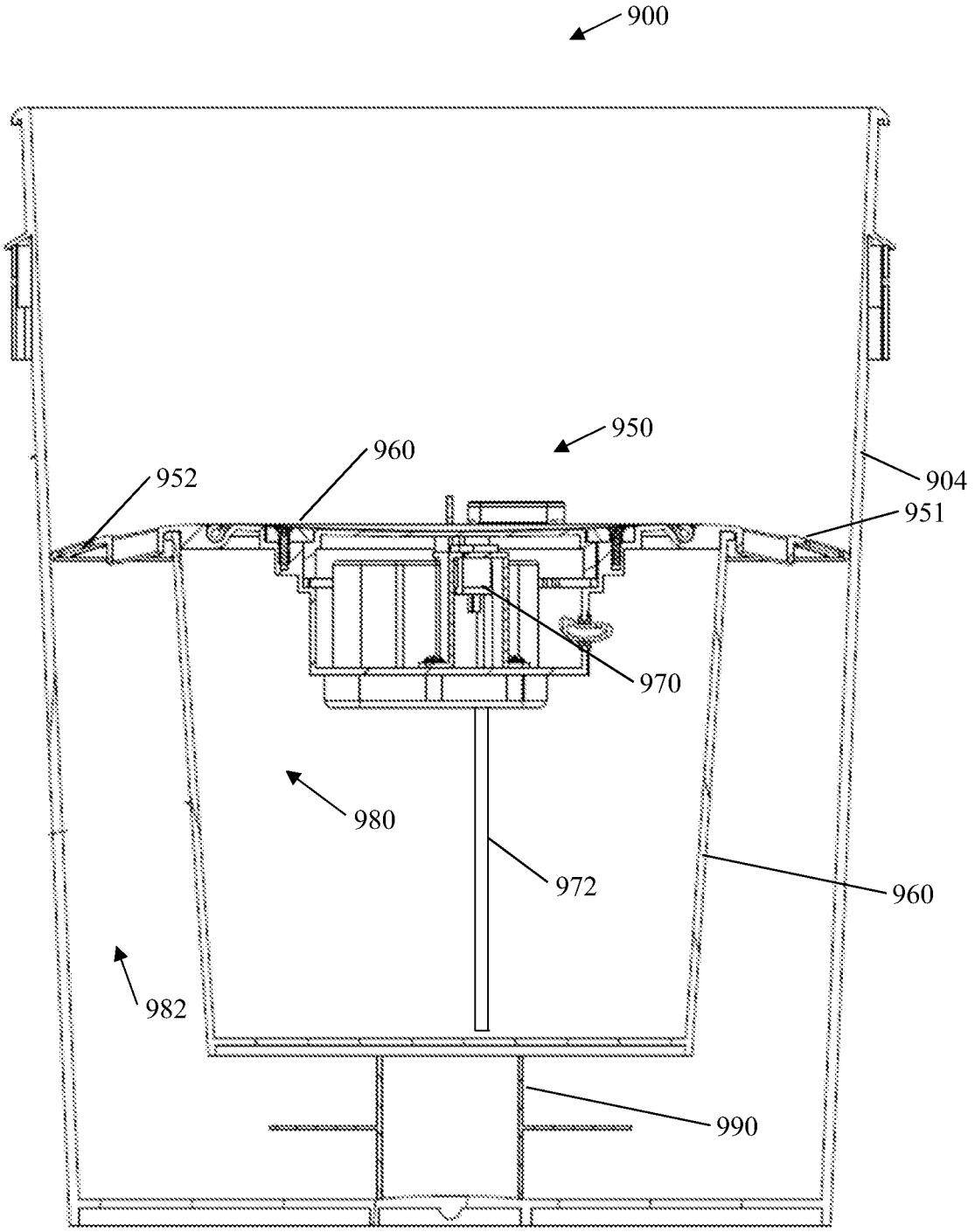
FIG. 9 is a cross-sectional view of another exemplary embodiment of a cleaning apparatus.

FIG. 9 is another exemplary embodiment of an cleaning apparatus 900. In this exemplary embodiment, container 904 may be a standard bucket. An insert 950 is inserted into container 904. Container 904 forms a dirty water containment area. Insert 950 includes a surface 951 that includes one or more dirty water openings 952 to allow dirty water to flow into dirty water reservoir 982 as described above. Insert 950 induces a clean water containment wall 960 that forms a cleaning solution reservoir 980. In this exemplary embodiment, dirty water reservoir 982 surrounds clean water reservoir 980. Located below cleaning solution containment wall 960 is a spacer 990. Spacer 990 allows for dirty water reservoir 982 to be larger and is preferably sized so that after all of the cleaning solution in cleaning solution reservoir 980 is used and disposed of in dirty water reservoir 982, insert 950 does not float. In some embodiments, insert 950 is secured to bucket 904 with one or more attachments as described above.

The components and functions of the components in insert 950 are similar to those that have been described above and are not re-described herein. The insert includes a dip tube 972, a pump 970, cleaning solution dispensing surface 960, a sloped dirty water surface 951 and one or more dirty water openings 952.

During operation (which is described with respect to one embodiment, but applies to others as well) a user fills the clean water reservoir 382 with cleaning solution and optionally fills the concentrate container 324 with concentrated cleaning fluid. In some embodiments, no concentrate container is included and cleaning fluid (if needed) is added to the cleaning solution reservoir 382. The user initiates activation of the pump via switch 310. In some embodiments, the pump is a manually activated pump and the user manually operates the pump by, for example, pushing downward. When the pump 312 is activated, cleaning solution is drawn up from reservoir 382 via dip tube 311 into pump 312 and pumped put of fluid outlet conduit 316 thru venture 318 which causes concentrated fluid to mix with the cleaning solution and the mixed fluid flows through conduit 320 and out of dispensing surface 220 and cleaning fluid outlets 222. The user moves a substrate, such as, for example, a sponge or rag around the surface 210 and over the cleaning fluid outlets 222 to sufficiently wet the substrate and the pump is deactivated by, for example, pressing switch 310. The user then uses the substrate to wash a surface and rings the substrate out over surface 201. Dirty water from the substrate travels down surface 201, flows through dirty water openings 202 and into dirty water reservoir 380. The process is repeated until the surface is clean. The insert 200 is readily removable from the housing to empty the dirty water reservoir. Thus, the inventive concepts provides a system that provides for always obtaining fresh cleaning solution and prevents the contamination of the cleaning solution during the cleaning process.

Figure 10:
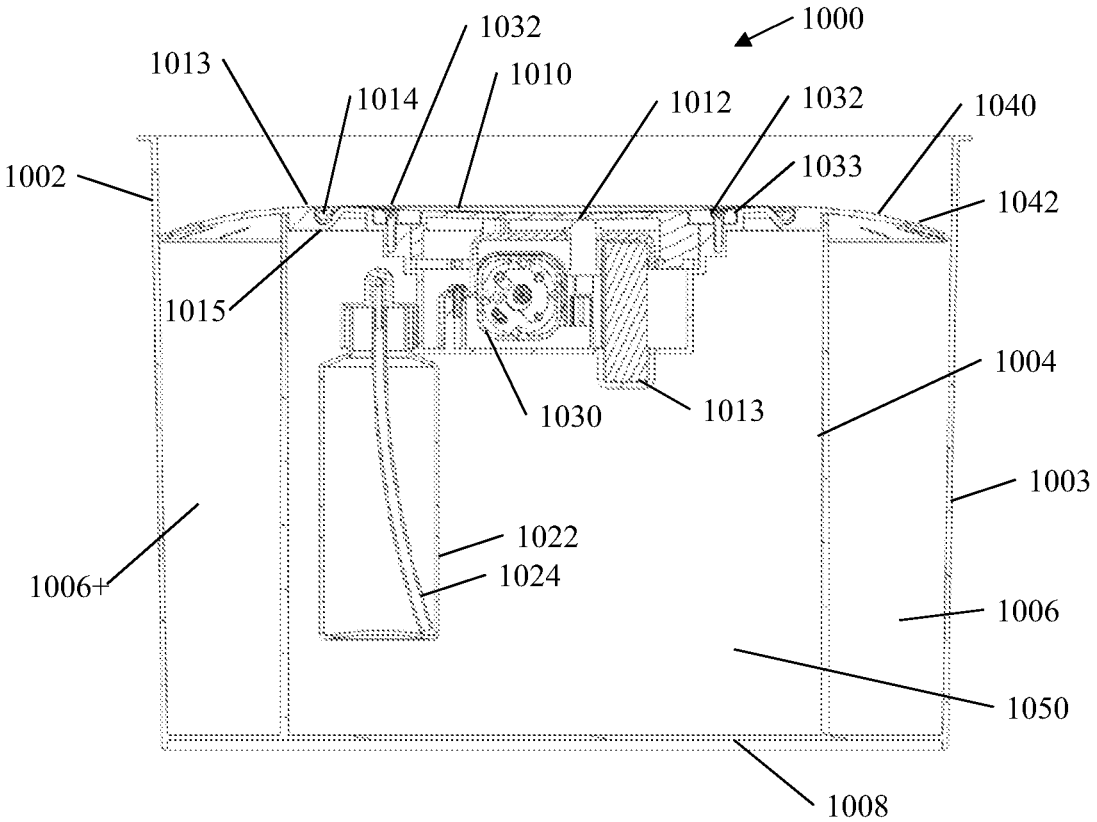
FIG. 10 is a cross-sectional view of an exemplary cleaning apparatus for wetting a substrate using a single solution.

FIG. 10 is a cross-sectional view of another exemplary cleaning apparatus 1000. Cleaning apparatus 100 includes a container 1102. Container 1002 has an outer wall 1003 and a bottom 1008. In this exemplary embodiment, cleaning apparatus 1000 includes a inner containment wall 1004. A dirty water containment area 1006 is formed between containment walls 1003 and 1004. Dirty water containment area 1006 receives excess cleaning solution, dirty or used cleaning solution and any dirt and grime rung out of a substrate that is wetted using the cleaning apparatus 1000 and used to clean an area or surface. Cleaning apparatus 1000 includes a wetting surface 1010, an "on" or "on/off" switch 1012. Wetting surface 1010 is lined with a membrane 1015.

Membrane 1015 connects to surface 1013 via a groove 1015 and bead 1014 connection. Other means for connecting membrane 1015 to surface 1013 are contemplated herein. Preferably the other means provides for a surface that has minimal crevasses or areas that may collect dirt or grime. In addition, cleaning apparatus as a dirty water removal surface 1040 that is sloped downward and includes one or more dirty water drain slots 1042. Cleaning apparatus 1000 includes a pump 1030, a power source 1013, a cleaning fluid container 1022 and a dip tube 1024. Wetting surface 1010 also includes one or more cleaning solution outlet ports 1032. In this exemplary embodiment, the one or more cleaning solution outlet ports 1032 are located in a ring 1033.

In this exemplary embodiment, cleaning fluid container 1022 contains a cleaning fluid or solution. Pump 1030, which may be one of the sequentially activated diaphragm pumps incorporated herein, is in fluid communication with the cleaning fluid via dip tube 1024 and connecting tubing (not shown). In addition pump 1030 is in fluid communication with the one or more cleaning fluid outlet ports 1032 via additional tubing (not shown) and or fluid channels (not shown). In this exemplary embodiment, cleaning fluid container 1024 is illustrated as a small container within cavity 1050, however, cleaning fluid container 1024 may be any size and may fill the entire cavity 1050.

During operation a user obtains a substrate to wet using cleaning apparatus 1000. The user causes cleaning apparatus 1000 to dispense cleaning fluid by, for example, activating switch 1012. Power from power supply 1013 is transferred to pump 1030. Pump 1030 is activated and fluid is drawn up from cleaning fluid container 1022 and dispensed out of the one or more cleaning fluid outlet ports 1032. After a period of time, or when the user activates switch 1012, power is removed from pump 1030 and the fluid stops flowing out of cleaning fluid outlet ports 1032. As fluid is flowing out of cleaning fluid outlet ports 1032, the user may move a substrate, such as, for example, a wipe, a towel, a sponge, or the like around on the wiping/wetting surface 1010 and across the cleaning fluid outlet ports 1032 to wet the substrate. The user may dispose of the substrate after cleaning a surface, if the substrate is, for example, a disposable substrate, such as, for example, a wipe. If the substrate is a reusable substrate, the user may wring the substrate out over the sloped surface 104, and any fluid will flow through drain slots and into dirty water containment area 1006.

Figure 11:
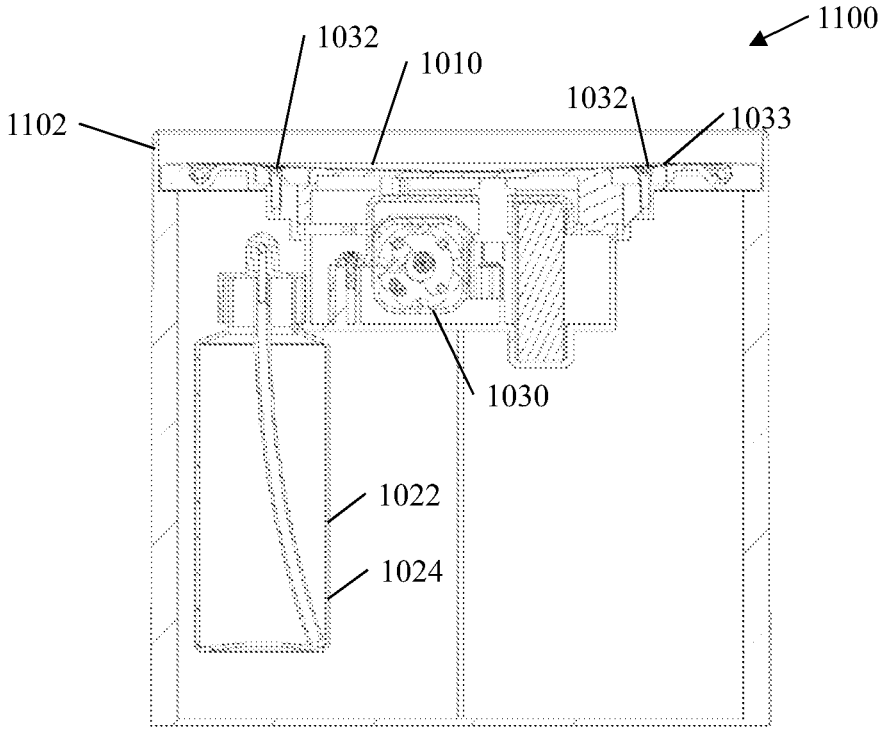
FIG. 11 is a cross-sectional view of an exemplary cleaning apparatus for wetting a substrate using a single cleaning solution.

FIG. 11 is another exemplary embodiment of a cleaning apparatus 1100. Cleaning apparatus 1100 is similar to cleaning apparatus 1000 and like number components are not re-described herein. Cleaning apparatus 1100 does not include a dirty water containment area 1006, sloped surface 1040 or dirty water drain slots 1042. Cleaning apparatus 1100 includes a containment rim 1102. Containment rim 1102 prevents cleaning fluid from flowing onto a floor or other surface. Cleaning apparatus 1100 is preferably used with disposable substrates, such as, for example, non-woven wipes.

Figure 12:
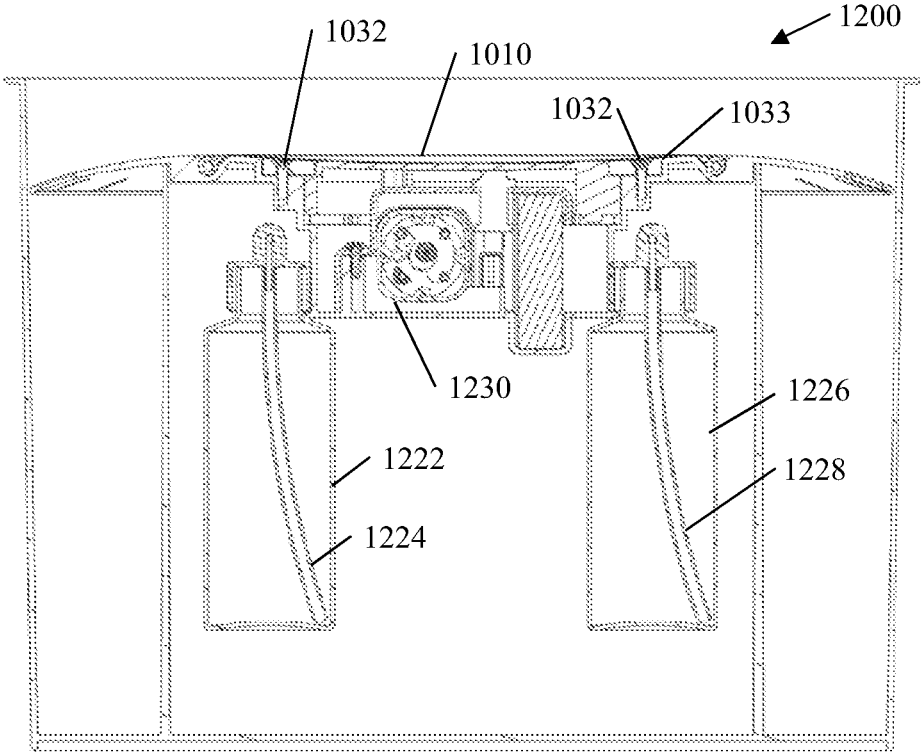
FIG. 12 is a cross-sectional view of an exemplary cleaning apparatus for wetting a substrate using two or more solutions.

FIG. 12 is another exemplary embodiment of a cleaning apparatus 1200. Cleaning apparatus 1200 is similar to cleaning apparatus 1000 and like number components are not re-described herein. Cleaning apparatus 1200 includes a second cleaning fluid container 1226. In some embodiments, the cleaning fluid in first cleaning fluid container 1222 and the cleaning fluid in second fluid container 1226 react when mixed together to form a more potent or active cleaning fluid. In some embodiments, the fluid in first cleaning fluid container 1222 and the cleaning fluid in second cleaning fluid container 1222 provide superior cleaning, disinfecting, sanitizer, power if they are mixed with one another immediately prior to use. In some embodiments the two cleaning fluids are not stable, or separate from one another if let sit after mixing. Pump 1230 may be one of the sequential activated diaphragm pumps incorporated herein. In this exemplary embodiment, one or more of the pump diaphragms may be configured to pump the first cleaning fluid and the remaining pump diaphragms may be configured to pump the second cleaning fluid. In some embodiments, there are three or more cleaning fluid containers and the pump 1230 is configured to pump and mix together 3 or more cleaning fluids prior to dispensing the mixture out of the cleaning fluid outlet ports 1032.

Figure 13:
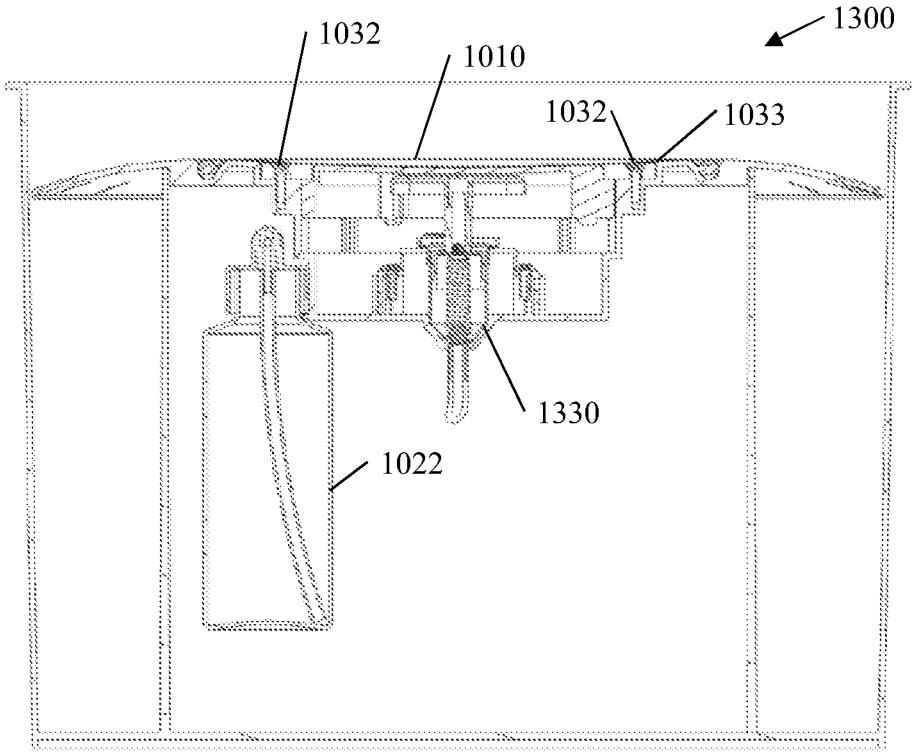
FIG. 13 is a cross-sectional view of an exemplary cleaning apparatus for wetting a substrate using a single solution and a manual pumping operation.

FIG. 13 is another exemplary embodiment of a cleaning apparatus 1300. Cleaning apparatus 1300 is similar to cleaning apparatus 1000 and like number components are not re-described herein. Cleaning apparatus 1300 is a manually activated cleaning apparatus 1300. Cleaning apparatus 1300 has a manual pump 1330 that is activated by pushing down on plunger 1350. Plunger 1350 includes a biasing member (not shown) to biased the plunger 1350 upward. When plunger 1350 is moved downward by a user, pump 1330 pumps cleaning fluid out of cleaning fluid container 1022 and out of cleaning fluid outlet ports 1032.

Figure 14:
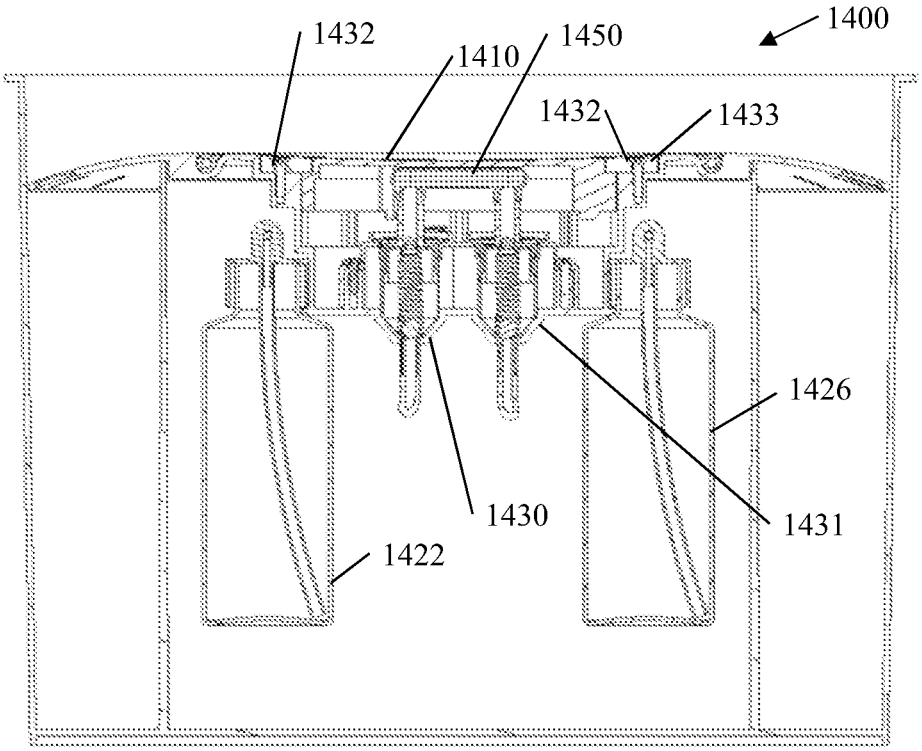
FIG. 14 is a cross-sectional view of an exemplary cleaning apparatus for wetting a substrate using two or more solutions and a manual pumping operation.
Figure 15:
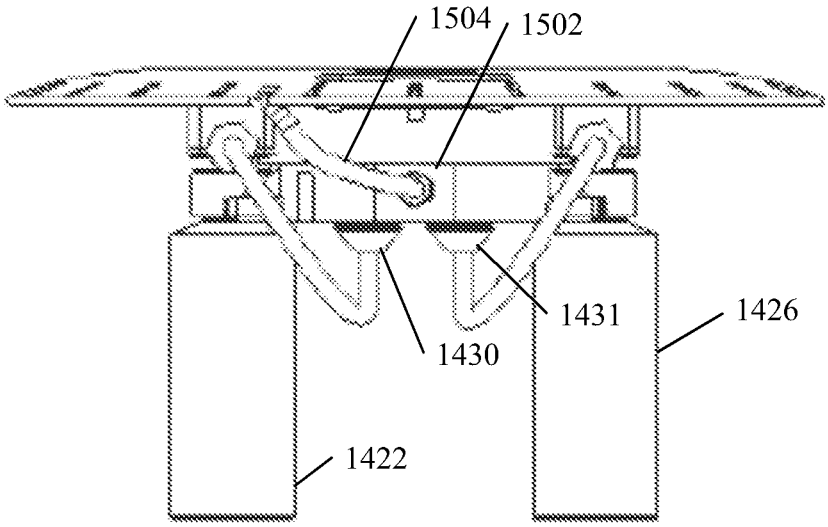
FIG. 15 is a side view of a portion of the cleaning apparatus of FIG. 14.

FIGS. 14 and 15 are another exemplary embodiment of a cleaning apparatus 1400. Cleaning apparatus 1400 is similar to cleaning apparatuses 1300 and 1200 and like number components are not re-described herein. Cleaning apparatus 1400 is a manually activated cleaning apparatus 1400. Cleaning apparatus 1400 has two manual pumps 1430, 1431 that are activated by pushing down on plunger 1450. Plunger 1450 includes a biasing member (not shown) to biased the plunger 1450 upward. When plunger 1450 is moved downward by a user, pumps 1430, 1431 pump cleaning fluid out of cleaning fluid containers 1422, 1426 into mixing chamber 1502 where the two fluids are mixed together and the fluid mixture is pumped out of cleaning fluid outlet ports 1432.

Figure 16:
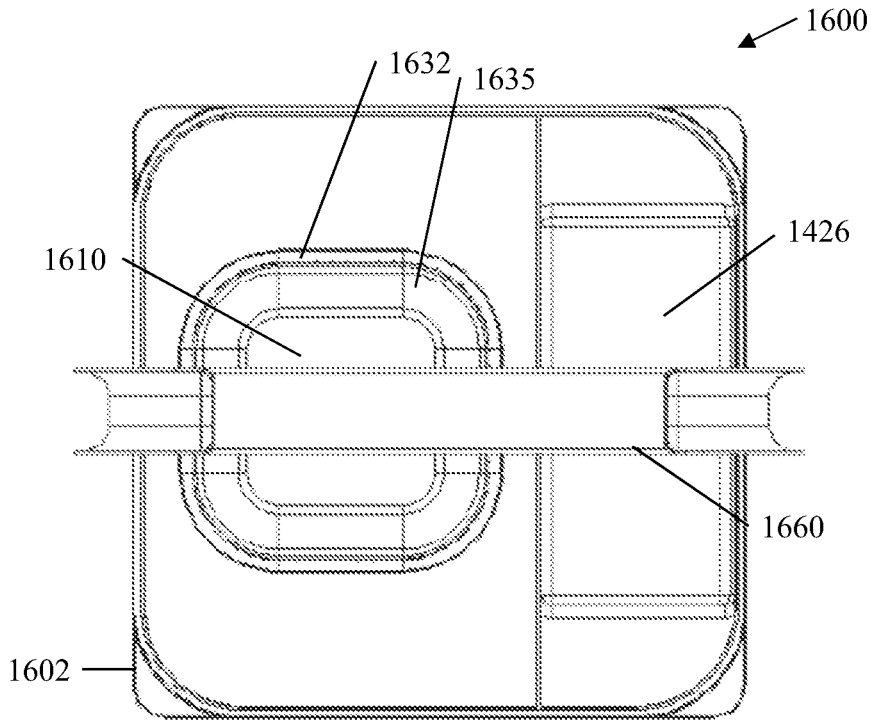
FIG. 16 is a plan view of an exemplary cleaning caddy with a single cleaning solution.
Figure 17:
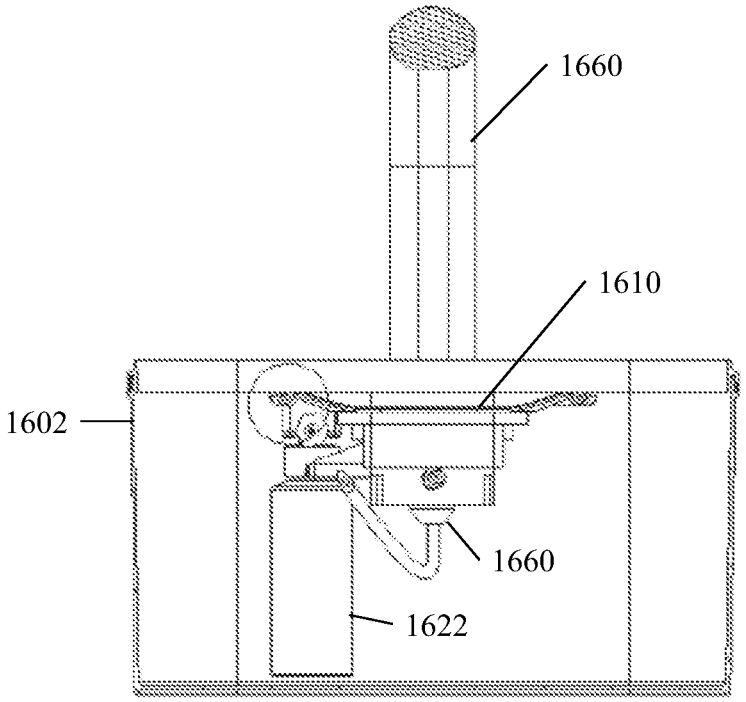
FIG. 17 is a cross section of the exemplary cleaning caddy of FIG. 16.
Figure 18:
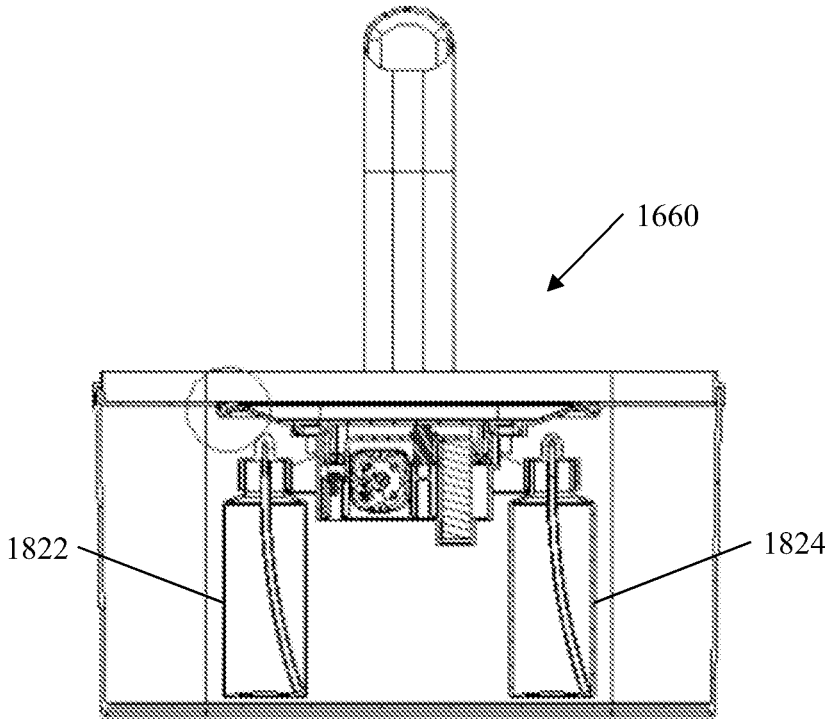
FIG. 18 is a cross-sectional view of an exemplary cleaning caddy having two or more cleaning solutions.

FIG. 16 is an exemplary embodiment of a cleaning caddy 1600. Cleaning caddy 1600 includes many of the same components disclosed in previous embodiments. Cleaning caddy 1600 includes a housing 1602 and a handle 1660, and a storage compartment 1650. In some embodiments, storage compartment 1650 is used to store a plurality of dry wipes or non-wovens that may be used to clean a surface. Cleaning caddy 1600 includes a wiping/wetting surface 1610, one or more cleaning fluid outlet ports 1632 and a sloped surface 1635. The sloped surface 1635 causes cleaning fluid to flow down to wiping/wetting surface 1610. Cleaning caddy 1600 operates similarly to the embodiments described above and includes a pump 1630, which may be a manual pump or an electric pump. In this exemplary embodiment, cleaning caddy 1600 has a single cleaning fluid container 1622. FIG. 18 is another exemplary embodiment of a cleaning caddy 1800. Cleaning caddy 1800 is similar to exemplary embodiment in FIG. 17, but has two or more fluid cleaning containers 1822, 1824. The two fluids are mixed together prior to being dispensed out of the fluid outlets (not shown).

Figure 19:
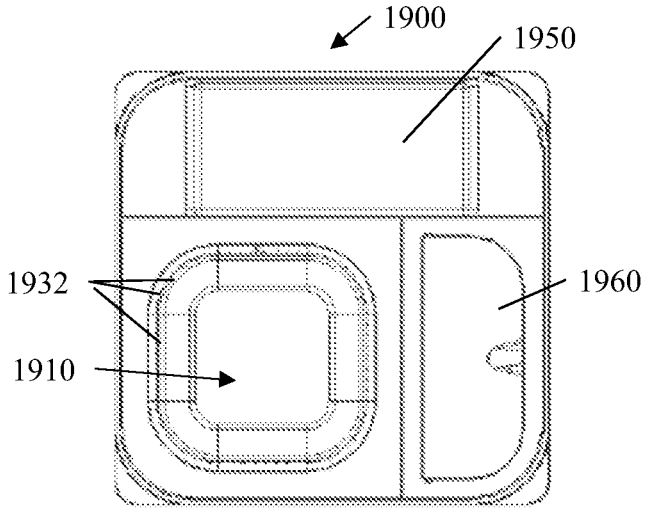
FIG. 19 is a plan view of another exemplary cleaning caddy.

FIG. 19 is a plan view of another exemplary embodiment of a cleaning caddy 1900. Cleaning caddy 1900 includes a wetting/wiping surface 1910, one or more cleaning outlet fluid ports 1932, a substrate storage compartment 1960 and a trash receptacle 1950.

Figure 20:
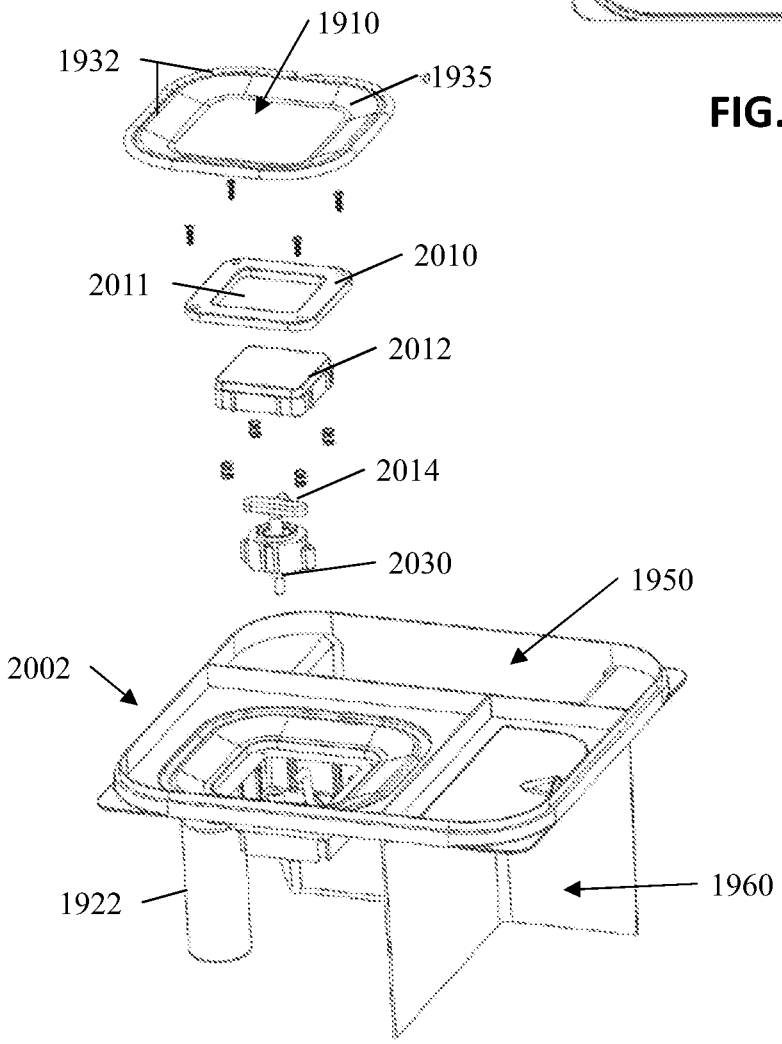
FIG. 20 is an exploded partial view of the exemplary cleaning caddy of FIG. 19.

FIG. 20 is an exploded prospective view of the cleaning caddy 1900. Cleaning caddy 1900 includes a base 2002, which has an opening for the trash receptacle 1950 and shows substrate storage compartment 1960. In this exemplary embodiment, cleaning caddy 1900 has a insert 1935 having a sloped surface, one or more cleaning water outlet ports 1932 located around the perimeter of the insert 1935. A sealing member 2010 having a membrane 2011 is located below the sloped surface of the insert 1935. In the instant case, the membrane 2011 is the wetting/wiping surface. A pushbutton 2012 is located below the membrane and may be actuated by pushing on the pushbutton 2012 through membrane 2010. A biasing member (not shown) may be used to bias pushbutton 2012 upward. A switch 2014 is located below pushbutton 2012 for turning on and off the supply of cleaning fluid to the one or more cleaning fluid outlet ports 1932. A pump 2030 is located below switch 2014, although the pump 2030 may be located away from the switch. A cleaning fluid container 1922 is also provided. The contents of the cleaning fluid container 1922, the pump 2030 and the cleaning fluid outlet ports 1932 are in fluid communication with one another.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A cleaning apparatus for wetting a substrate comprising:

a housing;

a substrate wetting/wiping surface secured to the housing;

the substrate wetting/wiping surface located in a center of the housing;

a membrane located over at least a portion of the wetting/wiping surface;

the membrane having a solid surface that prevents liquid from flowing through;

a plurality of cleaning fluid outlet ports located around the wetting/wiping surface;

a cleaning fluid reservoir;

a pump in fluid communication with the cleaning fluid reservoir and the plurality of cleaning fluid outlet ports; and an activation device for controlling the pump;

wherein the activation device is located below the wetting/wiping surface; and wherein the membrane is configured so that the activation device may be activated through a portion of the membrane.

2. The cleaning apparatus of claim 1 further comprising a dirty water reservoir and a draining surface located above at least a portion of the dirty water reservoir, wherein dirty water placed on the draining surface drains into the dirty water reservoir.

3. The cleaning apparatus of claim 1 further comprising a second cleaning fluid reservoir wherein fluid from the cleaning fluid reservoir and fluid from the second cleaning fluid reservoir are mixed with one another prior to being pumped out of the plurality of cleaning fluid outlet ports.

4. The cleaning apparatus of claim 3 wherein the pump is a sequentially activated diaphragm pump and one or more pump diaphragms are configured to pump a first cleaning fluid and one or more pump diaphragms are configured to pump a second cleaning fluid.

5. The cleaning apparatus of claim 1 wherein the pump is a sequentially activated diaphragm pump.

6. A cleaning apparatus for wetting a substrate comprising:

a housing;

the housing having a substrate wetting/wiping surface;

the wetting/wiping surface located in a center of the housing;

wherein the wetting/wiping surface is a solid surface;

the housing having an outer surface surrounding the wetting/wiping surface;

wherein the outer surface comprises one or more dirty water openings;

a cleaning fluid container;

a plurality of cleaning fluid outlet ports;

wherein the plurality of cleaning fluid outlet ports surround the wetting/wiping surface;

a pump for pumping fluid from the cleaning fluid container to the plurality of cleaning fluid outlet ports;

wherein fluid flowing out of the one or more cleaning fluid outlet ports flows onto the wetting/wiping surface;

an activation device located proximate the wetting/wiping surface;

wherein the activation device causes the pump to pump fluid from the cleaning fluid container to the wetting/wiping surface.

7. The cleaning apparatus of claim 6 wherein the activation device is manually activated.

8. The cleaning apparatus of claim 6 wherein the activation device utilizes touch-free activation circuitry.

9. The cleaning apparatus of claim 6 wherein the plurality of cleaning fluid outlet ports at least partially surround the wetting/wiping surface.

10. A cleaning apparatus for wetting a substrate comprising:

a housing;

the housing having a cleaning fluid reservoir; and a dirty water reservoir;

an insert for inserting into the housing;

the insert having:

a first surface covering at least a portion the dirty water reservoir;

wherein the first surface is configured to allow water to flow into the dirty water reservoir;

water reservoir;

a wetting/wiping surface;

wherein the wetting/wiping surface is a solid surface;

a plurality of cleaning fluid outlet ports located around the wetting/wiping surface;

wherein the first surface surrounds the wetting/wiping surface;

a pump for drawing cleaning fluid out of the cleaning fluid reservoir and pumping the cleaning fluid out of the plurality of cleaning fluid outlet ports; and an activation device for causing the pump to pump fluid from the cleaning fluid reservoir to the plurality of cleaning fluid outlet ports.

11. The cleaning apparatus of claim 9 wherein the activation device is a switch.

12. The cleaning apparatus of claim 11 wherein the switch is a push switch.

13. The cleaning apparatus of claim 11 wherein the switch is a touch free switch.

14. The cleaning apparatus of claim 9 pump is powered by a motor.

15. The cleaning apparatus of claim 9 further comprising a power source.

16. The cleaning apparatus of claim 9 further comprising a funnel having secured to the first surface for adding the cleaning fluid to the cleaning fluid reservoir.

17. The cleaning apparatus of claim 9 further comprising a concentrate container for holding a concentrated cleaning fluid for mixing with the cleaning fluid prior to the cleaning fluid being pumped out of a cleaning fluid dispensing member.

18. The cleaning apparatus of claim 9 further comprising a flexible membrane that forms at least a portion of the wetting/wiping surface.

19. The cleaning apparatus of claim 9 wherein the dirty water reservoir surrounds at least a portion of the cleaning fluid reservoir.

* * * * *